United States Patent [19]

Timmons

[11] 4,067,165

[45] Jan. 10, 1978

[54] PANEL SYSTEM

[75] Inventor: Jay Timmons, Palos Verdes Estates, Calif.

[73] Assignee: Hiebert, Inc., Torrance, Calif.

[21] Appl. No.: 743,360

[22] Filed: Nov. 19, 1976

[51] Int. Cl.[2] ..... E04B 2/72

[52] U.S. Cl. ..... 52/585; 52/238; 52/282

[58] Field of Search ..... 52/282, 238, 586, 241, 52/239, 585; 248/207

[56] References Cited

U.S. PATENT DOCUMENTS

| | | | |
|---|---|---|---|
| 2,321,671 | 6/1943 | Grotta | 52/712 |
| 2,681,483 | 6/1954 | Morawetz | 52/585 |
| 3,110,131 | 11/1963 | Jeffress | 52/585 |
| 3,798,860 | 3/1974 | Mason | 52/585 |

*Primary Examiner*—John E. Murtagh
*Attorney, Agent, or Firm*—Fraser and Bogucki

[57] ABSTRACT

A panel system includes thin, planar panels joined to each other at their edges and to corner posts by sleeve and dowel arrangements which provide proper alignment and by collar and pin arrangements which secure the panels to each other and to the corner posts so that a desired amount of force is required to separate the panels from each other and from the corner posts once the connection is made. Each sleeve and dowel arrangement includes a separate hollow sleeve mounted within each panel for receiving a common cylindrical dowel. Where a panel is joined to a corner post the dowel is permanently secured within the corner post. The sleeves of the topmost sleeve and dowel arrangement are of circular cross-section on the inside and slightly larger than the dowel so as to freely receive the dowel and yet align the joining panels in relatively precise fashion. The sleeves of the other sleeve and dowel arrangements have interiors which are oval-shaped in cross-section to provide a small amount of vertical tolerance as the dowels are received within the sleeves while at the same time providing relatively precise lateral alignment. Each collar and pin arrangement includes a pair of disk-shaped collars mounted on the panels or the panel and corner post to be joined. A common pin of hollow cylindrical configuration having a longitudinal slot extending from the inside to the outside thereof has opposite ends thereof forced into central apertures within the pair of collars. The longitudinal slot permits resilient compression of the cross-section of the pin to permit it to be forced through the central apertures of the collars as the panels are joined. The resilient nature of the pin provides a sufficient amount of force within the apertures of the collars so as to hold the panels secured together and permit separation thereof only when a sufficient amount of force is applied.

14 Claims, 10 Drawing Figures

Fig. 1
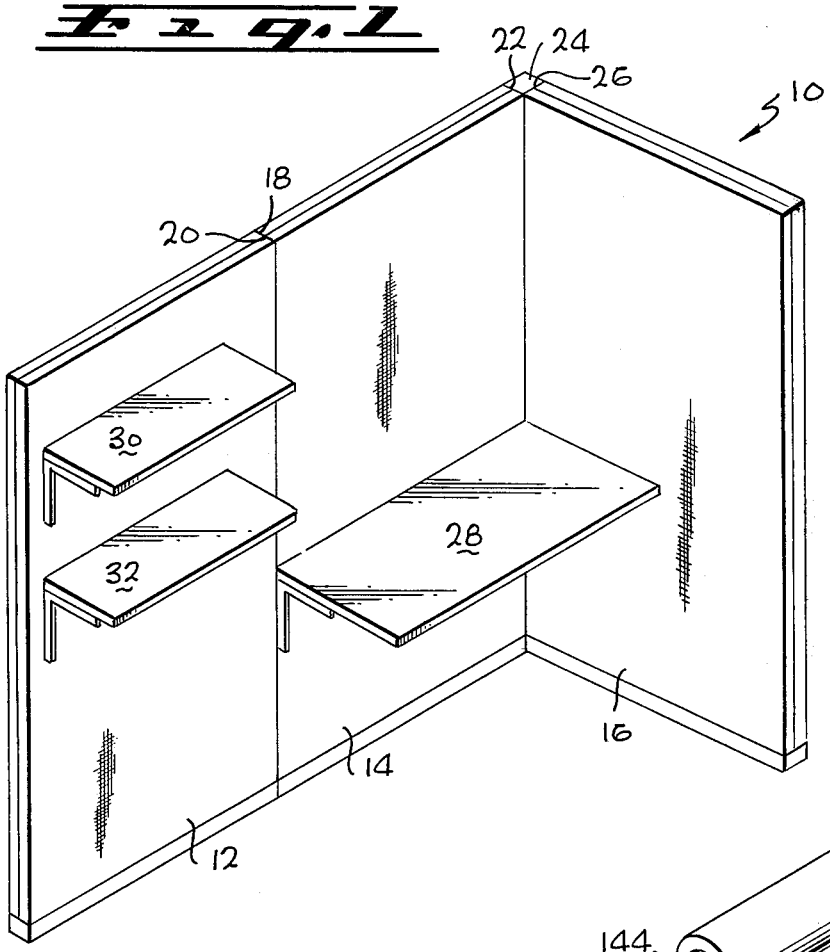
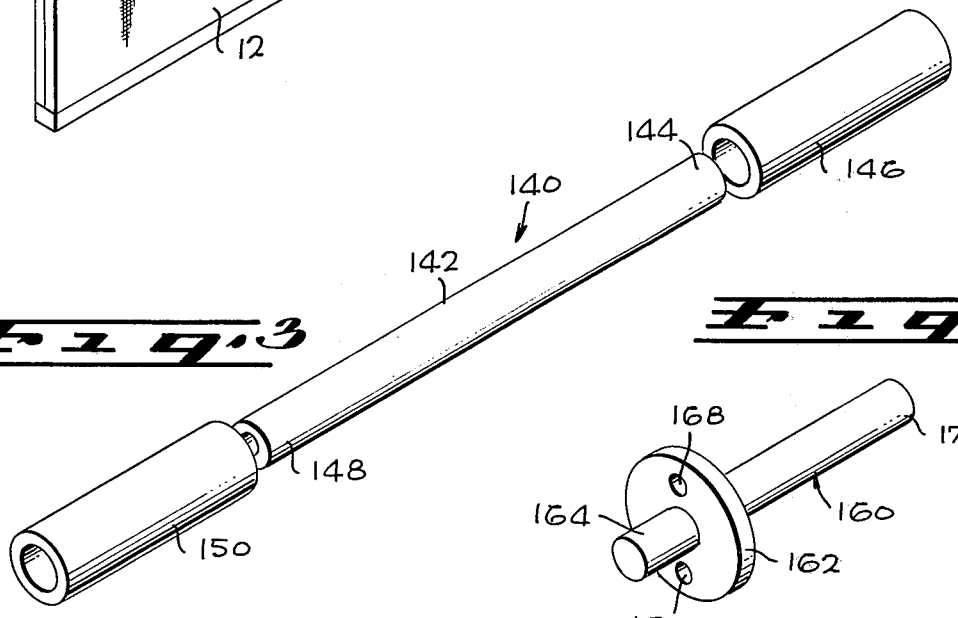
Fig. 3
Fig. 6
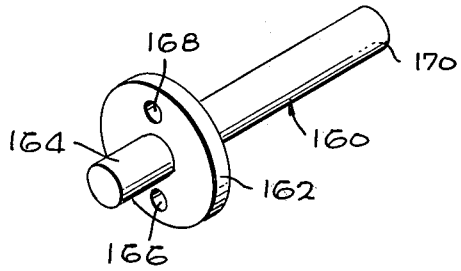
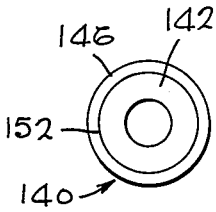
Fig. 4
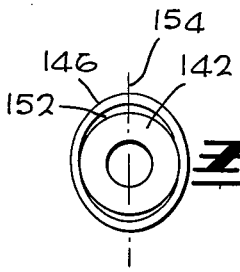
Fig. 5

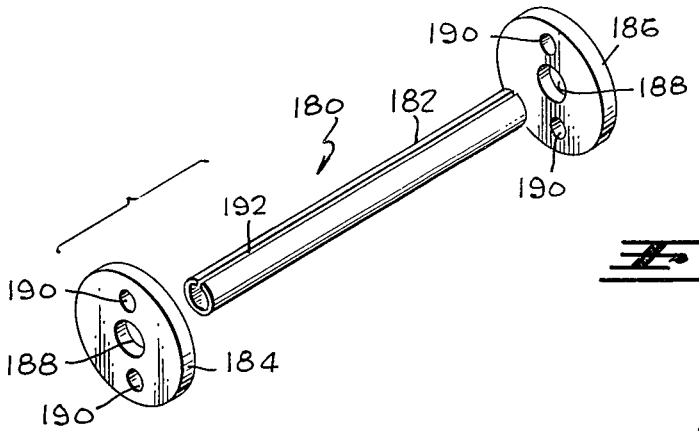
Fig. 7
Fig. 8
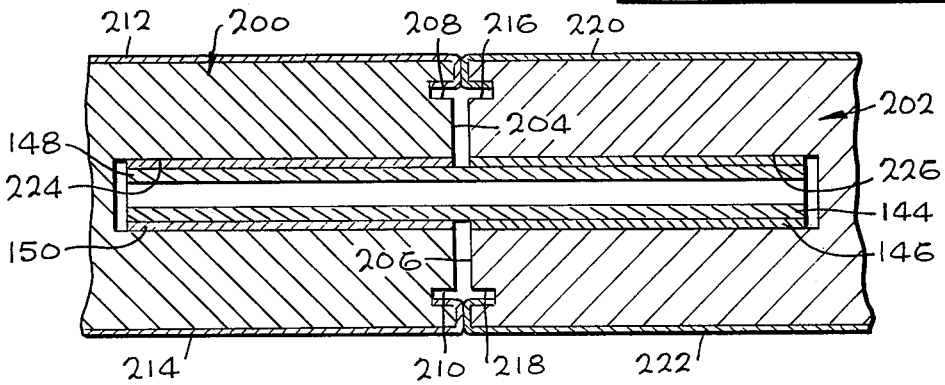
Fig. 9
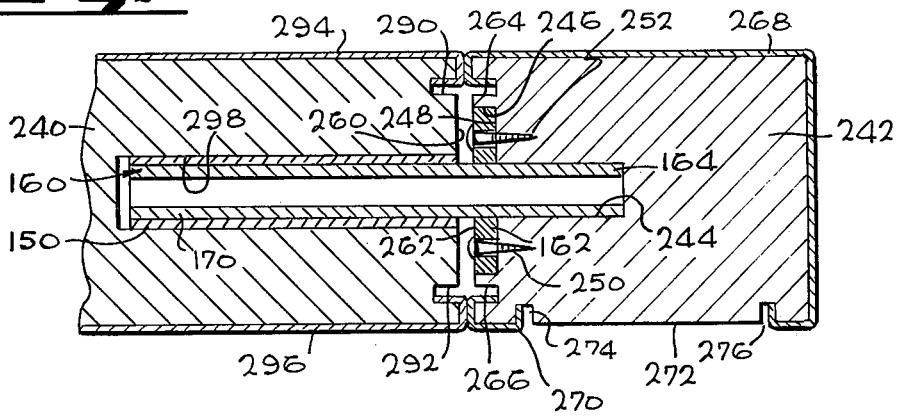
Fig. 10
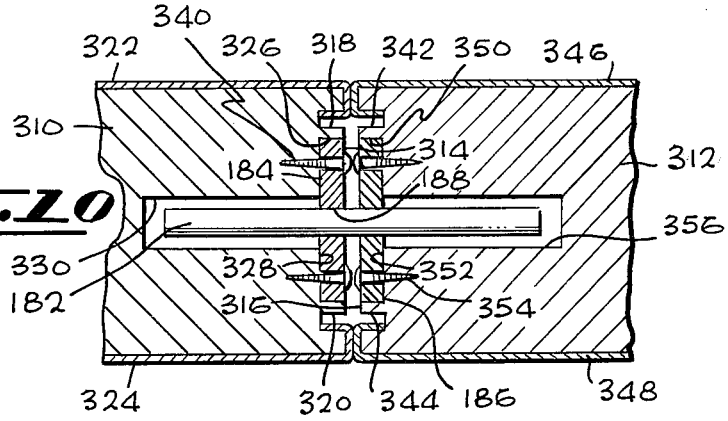

PANEL SYSTEM

BACKGROUND OF THE INVENTION

1. Field of the Invention

The present invention relates to arrangements for releasably joining structural members together, and more particularly to arrangements for releasably joining large panels of thin, planar configuration of the type used as office furnishings and the like.

2. History of the Prior Art

It is becoming increasingly popular ot furnish offices and other rooms or spaces using a panel system in which a plurality of large panels of thin, planar configuration and of like or different size are joined together. The joined panels form wall units which can act as partitions and which are used to support such objects as shelves and desk tops, resulting in work areas of desired configuration.

Panel systems are most effective when the individual panels, corner posts and the like are easily assembled and disassembled. The nature of most offices using such systems requires that the individual panels and other components be easily disassembled from an existing arrangement for assembly into a different arrangement in the same or a different location. At the same time the individual panels and other members of the system must be relatively firm and rigid when assembled so as to act much in the same manner as building walls and permanent pieces of furniture when assembled and put to use.

Those panel systems which have the requisite strength and rigidity upon assembly typically employ rather complex and cumbersome joining arrangements, requiring a great deal of time and effort in the assembly and disassembly of the units. Moreover, assembly and disassembly must often be accomplished by a trained worker or technician with such units. On the other hand, those panel systems providing for relatively easy assembly and disassembly usually lack the requisite rigidity and sturdiness necessary for proper use of the assembled panel system, particularly on a long term basis.

Accordingly, it would be desirable to provide an improved panel system.

It would furthermore be desirable to provide an improved panel system in which individual panels are joined to each other or to corner posts and other accessory parts therefore using a relatively simple arrangement providing for easy assembly and disassembly of the panels while at the same time providing a sturdy and rigid structure upon assembly.

BRIEF DESCRIPTION OF THE INVENTION

Panel systems in accordance with the invention employ panels which are releasably joined to each other and to corner posts using both a plurality of aligning means and a plurality of securing means at each joint. Each securing means includes an elongated element secured to a panel or corner post and received within a mating member mounting within the panel to be joined thereto. In the top aligning arrangement the mating member is of like shape and slightly larger in size than the elongated element so as to readily receive the elongated element therein while at the same time providing precise alignment in all directions. The mating members of the other aligning arrangements are of slightly different shape than the elongated element so as to provide relatively precise alignment in certain directions while providing desired tolerance in other directions. Each of the securing arrangements includes an elongated member secured to a panel or corner post and received within a securing member mounted within the panel to be joined thereto. The elongated member is resiliently deformable so that once received within the securing member it prevents separation of the panel unless a desired amount of force is applied.

In one preferred embodiment of a panel system according to the invention each aligning arrangement comprises a cylindrical dowel the opposite ends of which are received within a pair of hollow cylindrical sleeves mounted within the edges of panels to be joined. Where a panel is to be joined to a corner post only the panel is provided with a sleeve and the dowel is permanently attached to the corner post by way of a hollow, disk-shaped mounting member secured to the outer surface of the dowel adjacent one end thereof. The sleeves in the topmost aligning arrangement are circular in cross-section, while the sleeves in all other aligning arrangements are oval-shaped in cross-section to provide tolerance in vertical directions while providing relatively precise alignment in lateral directions. Each of the securing arrangements comprises a common pin of hollow cylindrical configuration having a longitudinal slot extending between the inside and the outside thereof. A pair of disk-shaped collars having central apertures therein are mounted on the two parts to be joined and receive the common pin within the central apertures. The cross-section of the pin is resiliently compressed such that the pin exerts an outward force on the apertures within the collars to resist separation of the collars in the a joined panels unless a selected amount of force is applied.

BRIEF DESCRIPTION OF THE DRAWINGS

The foregoing and other objects, features and advantages of the invention will be apparent from the following more particular description of the preferred embodiment of the invention, as illustrated in the accompanied drawings, in which:

FIG. 1 is a perspective view of a portion of a panel system according to the invention;

FIG. 3 is a perspective view of a dowel and mating sleeves of an aligning arrangement used in the panel system of FIGS. 1 and 2;

FIG. 4 is an end view of one type of sleeve shape of the aligning arrangement of FIG. 3;

FIG. 5 is an end view of another type of sleeve shape of the aligning arrangement of FIG. 3;

FIG. 6 is a perspective view of a dowel used in joining a corner post to a panel;

FIG. 7 is an exploded view of a pin and mating collars of a securing arrangement used in the panel system of FIGS. 1 and 2;

FIG. 8 is a sectional view of adjoining portions of a pair of panels showing the details of the dowel and sleeves of the aligning arrangement of FIG. 3;

FIG. 9 is a sectional view of a corner post and an adjoining portion of a panel showing the details of the dowel and sleeve of the aligning arrangement of FIG. 3; and FIG. 10 is a sectional view of adjoining portions of a pair of panels showing the details of the pin and collars of the securing arrangement of FIG. 7.

DETAILED DESCRIPTION

Figure 2:
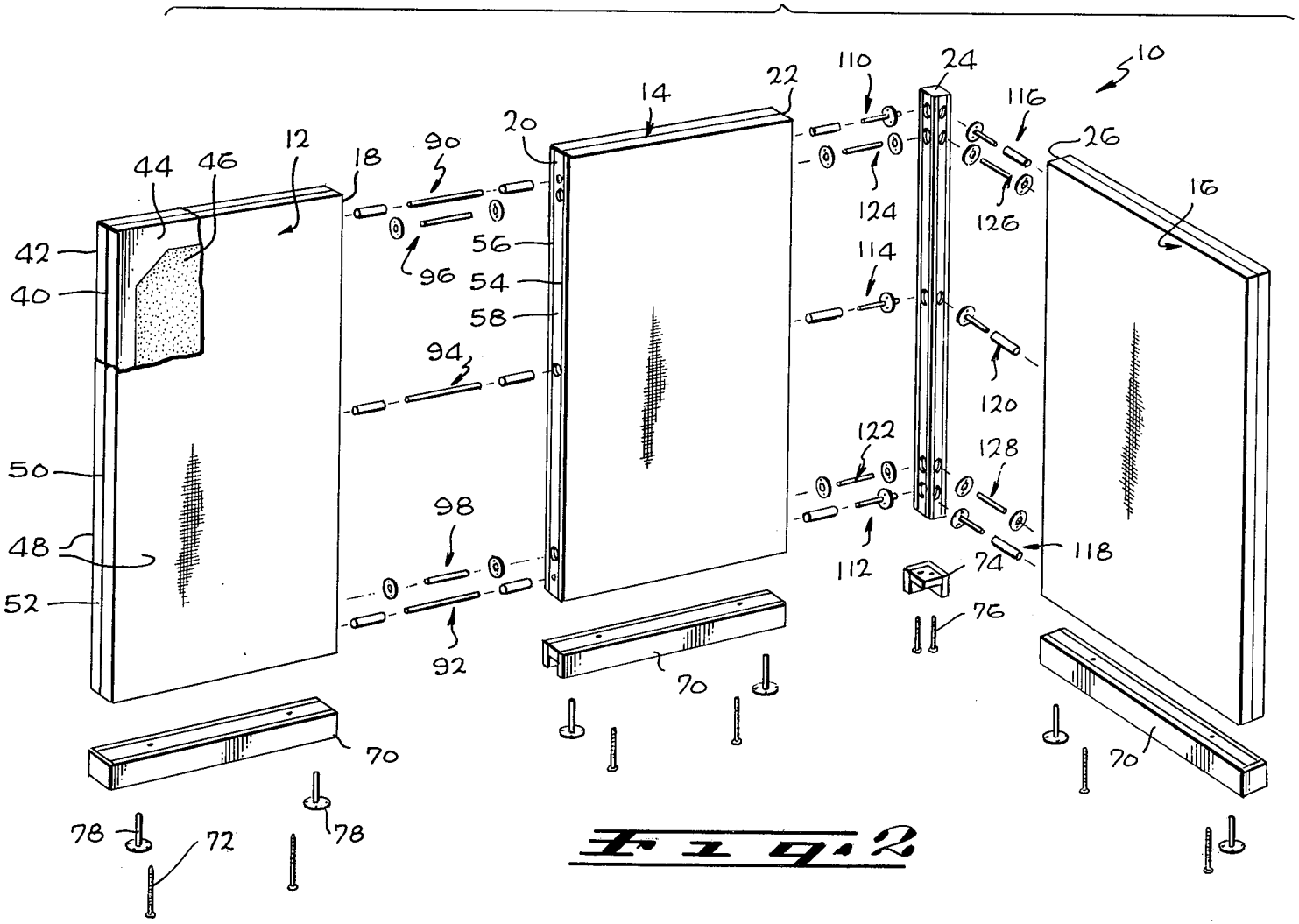
FIG. 2 is an exploded view of the panel system of FIG. 1 showing details of panel construction and joinder.

A panel arrangement 10 in accordance with the invention is shown in FIG. 1 as including panels 12, 14 and 16 of relatively thin, generally planar configuration. The panels 12 and 14 are disposed within the same plane and are joined at their ends 18 and 20 respectively. The end 22 of the panel 14 opposite the end 20 is joined to a corner post 24 as is the end 26 of the panel 16. Joinder of the panels 14 and 16 to the corner post 24 disposes the panels 14 and 16 at a generally right angle relative to one another.

In the example of FIG. 1 a desk top or other work-surface-defining element 28 is mounted on the panels 14 and 16 while a pair of shelves 30 and 32 are mounted on the panel 12. The desk top 28 and the shelves 30 and 32 are examples of the many accessories which can be added to the assembled panels so as to enable the panels to function as specific items of office furniture in addition to functioning as walls, partitions and the like. It will be apparent to those skilled in the art that many other arrangements in addition to that shown in FIG. 1 are possible using panels which can be releasably joined together.

FIG. 2 is an exploded view of the panel system 10 of FIG. 1 showing the details of the panels and the manner in which they are releasably joined to each other and to the corner posts in accordance with the invention. As shown by the cut-away portion of the panel 12, each panel is comprised of a thin, planar central frame member 40 defining the basic size of the panel and having a pair of edge frame members 42 and 44 secured to the opposite sides thereof around the outer circumference of the central frame member 40. Disposed within each of the edge frame members 42 and 44 and mounted on the central frame member 40 is a piece of acoustical material such as fiberglass with one such piece 46 being shown in FIG. 2. The central frame member 40, the edge members 42 and 44 and the acoustical pieces are covered by a fabric 48 which gives the panel an attractive finished appearance and also serves to pass sound waves to the acoustical material, enabling the panel to perform a sound deadening function. The edges of the fabric 48 are received in grooves in the panel where they are secured by appropriate means such as sizing and stapling. In the case of the panel 12, the edges of the fabric 48 are received and secured within a groove 50 in the central frame member 40 at the end 52 thereof opposite the end 18. The end 52 is completely covered by the fabric 48 since it is designed not to be joined to another panel or a corner post. Where the panel end in question is designed to be joined to another panel or corner post such as in the case of the end 20 of the panel 14, the opposite edges of the fabric 48 are secured within a pair of grooves 54 and 56 disposed in parallel, spaced-apart relation on the surface 58 defining the end 20. This enables the area of the surface 58 between the opposite grooves 54 and 56 to be used to mount the aligning and securing arrangements in accordance with the invention as described hereafter.

A base 70 is secured to the bottom of each of the panels 12, 14 and 16 by bolts 72. A post base 74 is secured to the bottom of the corner post 24 by bolts 76. Each of the bases 70 is provided with threaded feet 78 which extend from the bottom of the base 70 by distances which are adjustable to vary the height and angle of the panel relative to the floor.

The panels 12 and 14 are releasably joined to each other by aligning arrangements 90, 92 and 94 and by securing arrangements 96 and 98. The aligning arrangements 90, 92 and 94 serve to establish and maintain proper alignment of the panels 12 and 14 relative to each other during and after they are joined. The panels are held in the joined position by the joining arrangements 96 and 98 which hold the panels 12 and 14 together with a desired amount of force which must be overcome in order to separate the panels 12 and 14.

Each of the aligning arrangements 90, 92 and 94 includes a common dowel received within each of an opposite pair of hollow sleeves mounted within the two different panels 12 and 14. A plurality of aligning arrangements 110, 112 and 114 between the panel 14 and the corner post 24 and a plurality of aligning arrangements 116, 118 and 120 between the panel 16 and the corner post 24 are different from the aligning arrangements 90, 92 and 94 between the panels 12 and 14 in that a single sleeve is used and the dowel is permanently fastened to the corner post 24. The panel 14 is held against the corner post 24 by securing arrangements 122 and 124. The panel 16 is held against the corner post 24 by securing arrangements 126 and 128. The securing arrangements 122, 124, 126 and 128 are identical to the securing arrangements 96 and 98 between the panels 12 and 14.

The details of the aligning arrangements are shown in FIGS. 3–6. FIG. 3 shows an aligning arrangement 140 of the type used between a pair of panels and which is identical to the arrangements 90, 92 and 94 between the panels 12 and 14 in FIG. 2. The arrangement 140 includes a common dowel 142 of cylindrical configuration made of steel or other appropriate material. A first end 144 of the dowel 142 is received within a first sleeve 146 of hollow cylindrical configuration adapted to be mounted within the end of one of a pair of panels to be joined. The other end 148 of the dowel 142 is received within a second hollow cylindrical sleeve 150 adapted to be mounted within a second of the pair of panels being joined. The sleeves 146 and 150 are made of relative hard and durable material such as steel.

FIG. 4 illustrates one form of the aligning arrangement 140 in terms of the manner in which the dowel 142 is received within the sleeves such as the sleeve 146. In the form shown in FIG. 4 the inner wall of the sleeve 146 is circular in cross-section and slightly larger than the dowel 142. Accordingly, the dowel 142 is able to move relatively freely into and out of the sleeve 146. However, when the dowel 142 resides within the sleeve 146, lateral movement of the dowel relative to the sleeve is limited within a precise tolerance defined by the small, uniform space 152 between the outside of the dowel 142 and the inner wall of the sleeve 146.

The form of aligning arrangement shown in FIG. 4 is used at the top of the panels such as in the case of the arrangements 90, 110 and 116 of FIG. 2. Such arrangements provide for precise alignment of the panels 12, 14 and 16 and the corner posts 24 at the tops thereof.

A different form of aligning arrangement is illustrated in FIG. 5 in which the dowel 142 is disposed within the sleeve 146. While the cylindrical dowl 142 continues to have a circular cross-section in the form of FIG. 5, the sleeve 146 is oval-shaped in cross-section. Consequently, the space 152 between the outer surface of the dowel 142 and the inner surface of the sleeve 146 is not uniform but varies from a maximum at a vertical axis 154 where the inner diameter of the sleeve 146 is greatest to a minimum at the opposite sides of the arrangements where the inner diameter of the sleeve 146 is smallest.

The form of aligning arrangement shown in FIG. 5 is preferred for use as the middle and lower arrangements such as the aligning arrangments 92, 94, 112, 114, 118 and 120 in FIG. 2. The various sleeves are arranged such that the vertical axis 154 in the direction of greatest inner diameter thereof extends in the direction from bottom to top of the panel or corner post. This disposes the dowel within precise tolerances which provide considerable latitude in the vertical positioning of the dowel relative to the axis 154 while greatly limiting the tolerance between the dowel and the sleeve in a direction orthogonal thereto. This is a very useful feature in providing precise alignment of the adjoining panels and corner posts while at the same time providing relatively free joinder and separation of the panels and corner posts. Thus, in the arrangement of FIG. 2 the topmost aligning arrangements 90, 110 and 116 serve to precisely position and align the panels 12, 14 and 16 and the corner post 24 relative to each other in all lateral directions about the axes of the dowels and sleeves. The aligning arrangements 92, 94, 112, 114, 118 and 120 at the midpoints and the lower portions of the panels 12, 14 and 16 and the corner post 24 permit vertical tolerance in the positioning of the dowels required by the height of the panels and the corner posts. At the same time relative lateral movement to either side is prevented by the close tolerance in those directions.

FIG. 6 shows a dowel 160 used in aligning arrangements between a panel and a corner post such as the arrangments 110, 112, 114, 116, 118 and 120 in FIG. 2. The dowel 160 is shorter than the dowel 142 in the FIG. 3 arrangement and has a hollow, disk-shaped mounting member 162 mounted on the outside thereof adjacent a first end 164 of the dowel 160. The mounting member 162 which is made of steel or similar material is affixed to the outer surface of the dowel 160 of steel or other appropriate construction such as by welding. The end 164 of the dowel 160 is received within an aperture in the corner post, which aperture flares into a larger, disk-shaped aperture for accommodating the mounting member 162. An opposite pair of holes 166 and 168 in the mounting member 162 permit the use of screws, nails or other fastening means to permanently secure the dowel 160 to the corner post. An end 170 of the dowel 160 opposite the first end 164 is adapted to be received within a sleeve such as the sleeve 146 within the panel to be joined to the corner post.

FIG. 7 shows the details of a securing arrangement 180 corresponding to the securing arrangements 96, 98, 122, 124, 126 and 128 of the arrangement of FIG. 2. The securing arrangement 180 includes a common pin 182 and an opposite pair of disk-shaped collars 184 and 186. Each of the collars 184 and 186 has a central aperture 188 therein for receiving the opposite ends of the common pin 182 and a plurality of holes 190 at the outer periphery thereof for receiving screws, nails or other appropriate devices used to permanently fasten the collars 184 and 186 to the panel or corner post being joined.

The collars 184 and 186 of the securing arrangement 180 are made of an appropriate hard material such as steel such that the walls of the central apertures 188 remain rigid and of fixed size when receiving the opposite ends of the common pin 182. The pin 182 is of hollow cylindrical configuration and has a longitudinal slot 192 extending between inside and the outside thereof. The pin 182 is made of material such as steel which is strong and yet resilient. Because of the presence of the longitudinal slot 192 the pin 182 can be compressed so as to reduce the cross-sectional size thereof. When so compressed the pin 182 exerts radially outwardly directed forces because of the resiliency thereof which attempts to make the cross-section of the pin larger. Accordingly when the pin 182 is driven into the central apertures 188 in the collars 184 and 186, the pin 182 is compressed by the walls of the apertures 188 and the resulting force exerted against such walls by the pin results in a predetermined resistance to separation of the collars 184 and 186 and removal from the pin 182. Thus, with the collars 184 and 186 disposed adjacent one another on the pin 182 the panels or corner posts to which the collars 184 and 186 are permanently attached cannot be separated unless a predetermined force is applied.

Whereas the aligning means as shown in FIGS. 3-6 function to properly align the panels and corner posts and prevent undesired lateral movement while at the same time permitting relatively free movement of the dowel into and out of the sleeves to facilitate joinder and separation, the securing arrangement 180 shown in FIG. 7 functions to hold adjacent panels and corner posts together in such a way that they are readily separated from one another but only upon the application of a predetermined amount of force. The aligning and securing arrangements advantageously complement one another in accordance with the invention to provide a relatively simple joinder arrangement which provides for relatively easy joinder and separation while at the same time providing a sturdy, rigid structure when the panels and corner posts are joined. Joinder of the panels and corner posts is easily effected by starting the dowels into the sleeves of the aligning arrangements and the pins into the central apertures in the collars of the securing arrangements and then applying a force or striking one of the panels or the corner post to drive the opposite ends of the pins through the collars of the securing arrangements while at the same time sliding the dowels into the collars of the aligning arrangements. Separation is effected by applying the required force to one of the panels or corner posts so as to overcome the resiliency of the pins and pull them out of the collars in the securing arrangements while at the same time removing the dowels from the sleeves in the aligning arrangements. As a practical matter this can be accomplished by inserting the blade of a screw driver between the joined panels or corner post and prying them apart to effect an initial separation, following which a simple pulling motion on the panels or corner post while holding the other panel in place is usually sufficient to effect complete separation thereof.

FIG. 8 is a cross-sectional view of the aligning arrangement 140 of FIG. 3 installed within a pair of panels 200 and 202. Accordingly the arrangement of FIG. 8 corresponds to any of the aligning arrangements 90, 92 and 94 used in the joinder of the panels 12 and 14. The facing ends of the panels 200 and 202 are comprised of surfaces 204 and 206 respectively. The surface 204 has a pair of parallel, spaced-apart grooves 208 and 210 therein which correspond to the grooves 54 and 56 in the end 20 of the panel 14 and which receive and secure the ends of pieces of fabric 212 and 214 respectively which cover the outer surfaces of the panel 200. Likewise, the surface 206 of the panel 202 has grooves 216 and 218 for receiving the ends of pieces of fabric 220 and 222 respectively at the outer surfaces of the panel 202. Extending into the panel 200 from the surface 204 is a cylindrical aperture 224 which receives the sleeve 150. Likewise, the panel 202 has an aperture 226 extending inwardly from the surface 206 for receiving the sleeve 146. The cross-sectional dimensions of the apertures 224 and 226 are similar to the outer cross-sectional dimensions of the sleeves 146 and 150 so that the sleeves fit securely within the apertures. In some cases a force fit requiring that the sleeve be driven into the aperture may be sufficient to hold the sleeves securely within the aperture, although in other cases use of an adhesive or other appropriate means to secure the sleeve within the aperture may be desirable.

FIG. 9 is a sectional view of an aligning arrangement at the joinder of a panel 240 to a corner post 242. Accordingly, the aligning arrangement shown in FIG. 9 corresponds to the aligning arrangements 110, 112, 114, 116, 118 and 120 between the panels 14 and 16 and the corner post 24 in the arrangement of FIG. 2. The aligning arrangement of FIG. 9 includes the dowel 160 of FIG. 6 and the sleeve 150. The end 164 of the dowel 160 is disposed within a cylindrical aperture 244 in the corner post 242. The aperture 244 extends into the corner post 242 from a disk-shaped aperture 264 coaxial with the aperture 244 and which receives the disk-shaped mounting member 162 of the dowel 160. The aperture 264 has a supporting surface 248 at the back thereof which supports the mounting member 162. Screws 250 and 252 extend through the holes 166 and 168 respectively to secure the mounting member 162 within the mating aperture 246 and against the surface 248, thereby permanently securing the dowel 160 to the corner post 242.

The panel 240 and the corner post 242 are joined at facing surfaces 260 and 262 respectively. The surface 262 of the corner post 242 which has the apertures 246 and 244 extending inwardly therefrom includes a pair of opposite grooves 264 and 266 for receiving the ends of pieces of fabric 268 and 270 respectively. An adjacent surface 272 on the corner post 242 also has a pair of grooves 274 and 276 therein, the groove 274 receiving the other end of the piece of fabric 270 and a groove 276 receiving the other end of the piece of fabric 268. The surface 272 of the corner post 242 is like the surface 262 in that, while not shown in FIG. 9, it may include apertures such as the apertures 246 and 244 and a dowel such as the dowel 150 for joining a panel thereto so as to form a right angle with the panel 240 in the manner of the panels 14 and 16 shown in FIGS. 1 and 2.

The surface 260 of the panel 40 has an opposite pair of grooves 290 and 292 for receiving the ends of pieces of fabric 294 and 296 respectively which cover the panel 240. A cylindrical aperture 298 extends into the panel 240 from the surface 260 to receive the sleeve 150. The sleeve 150 receives the end 170 of the dowel 160 in the same manner that the opposite ends 144 and 148 of the dowel 142 are received within the sleeves 146 and 150 in the arrangement of FIG. 8.

FIG. 10 is a sectional view of the securing arrangement 180 of FIG. 7 installed within a pair of joined panels 310 and 312 having facing end surfaces 314 and 316 respectively. The surface 314 which has opposite grooves 318 and 320 for receiving the ends of pieces of fabric 322 and 324 respectively which cover the panel 310 has a disk-shaped aperture 326 extending into the panel between the grooves 318 and 320 for receiving the collar 184. The aperture 326 has a flat surface 328 which supports the collar 184. A cylindrical aperture 330 extends into the panel 310 from the surface 328 of the aperture 326 to receive one end of the pin 182 which has been inserted through the central aperture 188 in the collar 184. Screws 340 extend through the holes 190 in the collar 184 to permanently fasten the collar 184 to the panel 310.

The panel 312 is similarly constructed and includes opposite grooves 342 and 344 for receiving pieces of fabric 346 and 348 respectively, a disk-shaped aperture 350 having a back surface 352 for mounting the collar 186 via screws 354 and a cylindrical aperture 356 for receiving the opposite end of the pin 182.

In a panel system constructed and successfully tested in accordance with the invention, the individual panels range from 42 inches to 70 inches in height, from 12 inches to 52 inches in width and are approximately $2\frac{1}{2}$ inches thick. The dowel 142 of the aligning arrangement 140 shown in FIG. 3 is $\frac{1}{2}$ inch in diameter and $5\frac{1}{2}$ inches long. Each of the sleeves 146 and 150 is $2\frac{3}{4}$ inches long. The sleeves in the configuration of FIG. 4 have an outside diameter of approximately $\frac{5}{8}$ inch, a wall thickness of 0.58 inch and an inner diameter of 0.509 inch. In the configuration of FIG. 5 a cylindrical tube having a wall thickness of 0.49 inch and an inside diameter of 0.527 inch is squeezed so as to have an oval-shaped cross section which is 0.510 inch in diameter at its smallest dimension. The dowel 160 shown in FIG. 6 and used with the corner posts has a diameter of $\frac{1}{2}$ inch and a length of $3\frac{1}{2}$ inches. In the securing arrangement 180 shown in FIG. 7 the pin 182 is 2 inches long and has an outer diameter of approximately $\frac{1}{4}$ inch. In its uncompressed state the width of the slot 192 is approximately 0.257 inch. Each of the collars 184 and 186 is 1 inch in diameter and has a central aperture 188 having a diameter of 0.255 inch.

While the invention has been particularly shown and described with reference to a preferred embodiment thereof, it will be understood by those skilled in the art that various changes in form and details may be made therein without departing from the spirit and scope of the invention.

What is claimed is:

1. An arrangement for releasably joining a pair of panel members together, each of the panels having a relatively flat end surface, comprising the combination of a plurality of aligning means, each of which includes an elongated element extending from the end surface of one of the pair of panel members and means defining an aligning aperture adjacent the end surface of the other one of the pair of panel members to align the panel members with the end surfaces in contact with each other, the aligning aperture having a shape similar to and being slightly larger than the elongated element to provide relatively free movement of the elongated element into and out of the aligning aperture while preventing lateral movement of the elongated element within the aligning aperture, and a plurality of securing means, each of which includes an elongated member extending from the end surface of one of the pair of panel members in a direction generally parallel to the direction of elongation of the elongated element and means defining a securing aperture adjacent the end surface of the other one of the pair of panel members, the securing aperture being slightly smaller than the elongated member so as to bind the elongated member therein and secured the panel members together with the end surfaces in contact with each other.

2. The invention defined in claim 1, wherein one of the aligning means is located adjacent the top of the pair of panel members and has an elongated element o circular cross-section and an aligning aperture of circular cross-section slightly larger than the circular cross-section of the elongated element, and another one of the aligning means is located below said one of the aligning means and has an elongated element of circular cross-section and an aligning aperture having an oval-shaped cross-section slightly larger than the circular cross-section of the elongated element and disposed so that the maximum diameter thereof is in the general direction from the bottom to the top of the other one of the panel members.

3. The invention defined in claim 1, wherein the means defining a securing aperture has a rigid aperture therein of fixed size adapted to receive the elongated member therein and the elongated member is resiliently flexible in directions to reduce and enlarge the cross-section thereof as the elongated member is inserted into and removed from the rigid aperture of fixed size.

4. An arrangement for releasably joining a pair of panel members together comprising the combination of a plurality of aligning means, each of which includes an elongated element extending from one of the pair of panel members and adapted to be received within an aperture in the other one of the pair of panel members, the aperture having a shape similar to and being slightly larger than the elongated element to prevent relatively free movement of the elongated element into and out of the aperture while preventing lateral movement of the elongated element within the aperture, and at least one securing means including an elongated member extending from one of the pair of panel members and means secured to the other one of the pair of panel members and adapted to receive and secure the elongated member therein and present a desired amount of resistance to removal of the elongated member from the means adapted to receive, the elongated element of each aligning means extending from an aperture in said one of the pair of panel members which is like the aperture in said other one of the pair of panel members, and the elongated member of the at least one securing means extending from means secured to said one of the pair of panel members which is like said means secured to the other one of the pair of panel members and adapted to receive and secure the elongated member therein.

5. An arrangement for releasably joining a pair of panel members together comprising the combination of a plurality of aligning means, each of which includes an elongated element extending from one of the pair of panel members and adapted to be received within an aperture in the other one of the pair of panel members, the aperture having a shape similar to and being slightly larger than the elongated element to prevent relatively free movement of the elongated element into and out of the aperture while preventing lateral movement of the elongated element within the aperture, and at least one securing means including an elongated member extending from one of the pair of panel members and means secured to the other one of the pair of panel members and adapted to receive and secure the elongated member therein and present a desired amount of resistance to removal of the elongated member from the means adapted to receive, the elongated element of each aligning means having a hollow, disk-shaped member mounted on the outside of the elongated element and secured to said one of the pair of panel members to mount the elongated element thereon.

6. An arrangement for releasably joining a pair of panels together at their edges comprising a plurality of aligning means spaced apart along the edges of the pair of panels, each aligning means comprising a pair of hollow, cylindrical sleeves, each of which is disposed within a different one of the pair of panels at the edge thereof, and a common cylindrical dowel seated within and having a diameter slightly smaller than the inside dimensions of the pair of sleeves, and a plurality of securing means spaced apart along the edges of the pair of panels, each securing means comprising a pair of disk-shaped collars, each of which has a central aperture therein and is mounted on a different one of the pair of panels at the edge thereof, and a common hollow cylindrical pin having a longitudinal slot between the inside and outside thereof, the pin being disposed within and resiliently biased against the walls of the central apertures of the pair of collars.

7. The invention defined in claim 6, wherein the pair of sleeves of the aligning means closest to the tops of the pair of panels have circular interiors to provide precise alignment of the pair of panels and the pair of sleeves of the other aligning means have oval-shaped interiors to permit some tolerance in the alignment of the pair of sleeves relative to each other with the dowel seated therein.

8. The invention defined in claim 6, wherein there are three aligning means, a first and second of which are located adjacent the tops and bottoms respectively of the pair of panels and a third of which is located midway between the tops and bottoms of the pair of panels, and wherein there are two securing means located adjacent and on the inside of the first and third aligning means respectively from the tops and bottoms.

9. An arrangement for releasably joining a panel and an end post together at their edges comprising a plurality of aligning means spaced apart along the edges of the panel and end post, each aligning means comprising a hollow cylindrical sleeve disposed within the panel at the edge thereof and a cylindrical dowel having one end thereof disposed within the edge of the end post, a hollow disk-shaped element mounted on the outside thereof adjacent the one end and secured to the edge of the end post and an opposite end seated within and having a diameter slightly smaller than the inside dimensions of the sleeve, and a plurality of securing means spaced apart along the edges of the panel and end post, each securing means comprising a pair of disk-shaped collars, each of which has a central aperture therein, one of the pair of collars being mounted on the panel at the edge thereof and the other one of the pair of collars being mounted on the end post at the edge thereof, and a common hollow cylindrical pin having a longitudinal slot between the inside and outside thereof, the pin being disposed within and resiliently biased against the walls of the central apertures of the pair of collars.

10. A relatively flat, generally planar panel having at least one surface adapted to be joined to an adjacent panel or support member, said surface having a first plurality of holes therein, a plurality of hollow cylindrical sleeves, each being mounted within a different one of the first plurality of holes so as to extend into the hole from said surface, each of the sleeves being adapted to receive a cylindrical dowel therein to align the panel with an adjacent panel or support member, a second plurality of holes in said surface, each of which has a first portion of given diameter extending into the panel and terminating at a collar-supporting surface parallel to said surface of the panel and a second portion of diameter substantially smaller than the given diameter extending into the panel from the collar-supporting surface to define a pin-receiving aperture, a plurality of disk-shaped collars, each having a central aperture therein and being disposed within the first portion of a different one of the second plurality of holes and secured against the collar-supporting surface, each of the collars being adapted to pass a cylindrical pin through the central aperture thereof and into the pin-receiving aperture to releasably secure the panel via the pin to an adjacent panel or support member.

11. The invention defined in claim 10, wherein the panel includes a second surface adapted to be joined to an adjacent panel or support member, the second surface being like said at least one surface and including a first plurality of holes having sleeves therein and a second plurality of holes having collars therein.

12. The invention defined in claim 10, wherein said surface of the panel comprises a side edge of the panel extending between the top and the bottom of the panel, the first plurality of holes therein includes a first hole adjacent the top of the panel, a second hole adjacent the bottom of the panel and a third hole midway between the first and second holes, and the second plurality of holes in said surface includes first and second holes adjacent the first and second holes respectively of the first plurality of holes.

13. The invention defined in claim 12, wherein the first hole of the first plurality of holes has a sleeve mounted therein which has an interior of circular cross-section and the second and third holes of the first plurality of holes have sleeves mounted therein which have interiors of oval-shaped cross-section with the greatest dimension of the oval being in the direction of elongation of the side edge of the panel.

14. The invention defined in claim 12, wherein said surface of the panel has a pair of grooves therein extending between the top and bottom of the panel on opposite sides of the first and second pluralities of holes and the side surfaces of the panel are covered with fabric having edges which extend around the edges of the side of the panel and terminate within the pair of grooves in said surface.

* * * * *

UNITED STATES PATENT AND TRADEMARK OFFICE

CERTIFICATE OF CORRECTION

PATENT NO. : 4,067,165

DATED : January 10, 1978

INVENTOR(S) : Jay Timmons

It is certified that error appears in the above-identified patent and that said Letters Patent are hereby corrected as shown below:

In the Abstract: column 2, line 19, after "has" and before "opposite", insert --the--. Column 1, line 12, "ot" should read --to--; line 60, "mounting" should read --mounted--. Column 4, line 42, "relative" should read --relatively--; line 62, "dowl" should read --dowel--. Column 6, line 46, after "collars", "in" should read --of--. Column 7, line 26, after "aperture" and before "coaxial", "264" should read --246--; line 29, before "has", "264" should read --246--. Column 9, line 1, "secured" should read --secure--; line 5, after "element" and before "cross-sec-", "o" should read --of--.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*